US006926645B1

(12) United States Patent
Stearns et al.

(10) Patent No.: US 6,926,645 B1
(45) Date of Patent: Aug. 9, 2005

(54) MULTI-MODE EXERCISE CYCLING METHODS AND APPARATUS

(76) Inventors: Kenneth W. Stearns, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 10/422,068

(22) Filed: Apr. 22, 2003

(51) Int. Cl.[7] ..... A63B 69/16
(52) U.S. Cl. ..... 482/62; 482/57; 601/36
(58) Field of Search ..... 482/57–59, 62–65, 482/51; 601/29, 31–36

(56) References Cited

U.S. PATENT DOCUMENTS 5,035,418 A * 7/1991 Harabayashi ..... 482/62
5,785,631 A * 7/1998 Heidecke ..... 482/5
6,135,930 A * 10/2000 Kuo ..... 482/72
6,379,285 B1 * 4/2002 Maresh et al. ..... 482/57
6,692,411 B1 * 2/2004 Stearns et al. ..... 482/57

* cited by examiner

*Primary Examiner*—Gregory L. Huson
*Assistant Examiner*—Tam Nguyen

(57) ABSTRACT

A stationary bike is adjustable through a range of configurations, including one suitable for recumbent cycling, another suitable for semi-recumbent cycling, and yet another suitable for mostly upright cycling. A handle assembly is mounted on the stationary bike, and provides left and right handle members that are operable in different modes of operation, including a stationary mode, a linked exercise mode, and an independent exercise mode.

25 Claims, 8 Drawing Sheets

172
188
186
287
182
284
178
184
209
193
288
196

MULTI-MODE EXERCISE CYCLING METHODS AND APPARATUS

FIELD OF THE INVENTION

The present invention relates to exercise methods and apparatus and specifically, to stationary cycling machines.

BACKGROUND OF THE INVENTION

Exercise equipment has been designed to facilitate a variety of exercise motions, including cycling motion. Examples of cycling equipment are disclosed in U.S. Pat. Nos. 6,379,285, 6,066,073, and 5,938,570. An object of the present invention is to provide novel cycling machines that offer multiple modes of operation.

SUMMARY OF THE INVENTION

The present invention provides methods and apparatus that facilitate more than one mode of cycling exercise. A preferred embodiment of the present invention may be described as a stationary cycling machine that adjusts through a range of configurations from recumbent, through different degrees of semi-recumbent, to mostly upright. Also, handles are preferably mounted on the machine for various uses, including stationary support, independent exercise movement, and linked exercise movement. Many features and advantages of the present invention may become more apparent from the detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
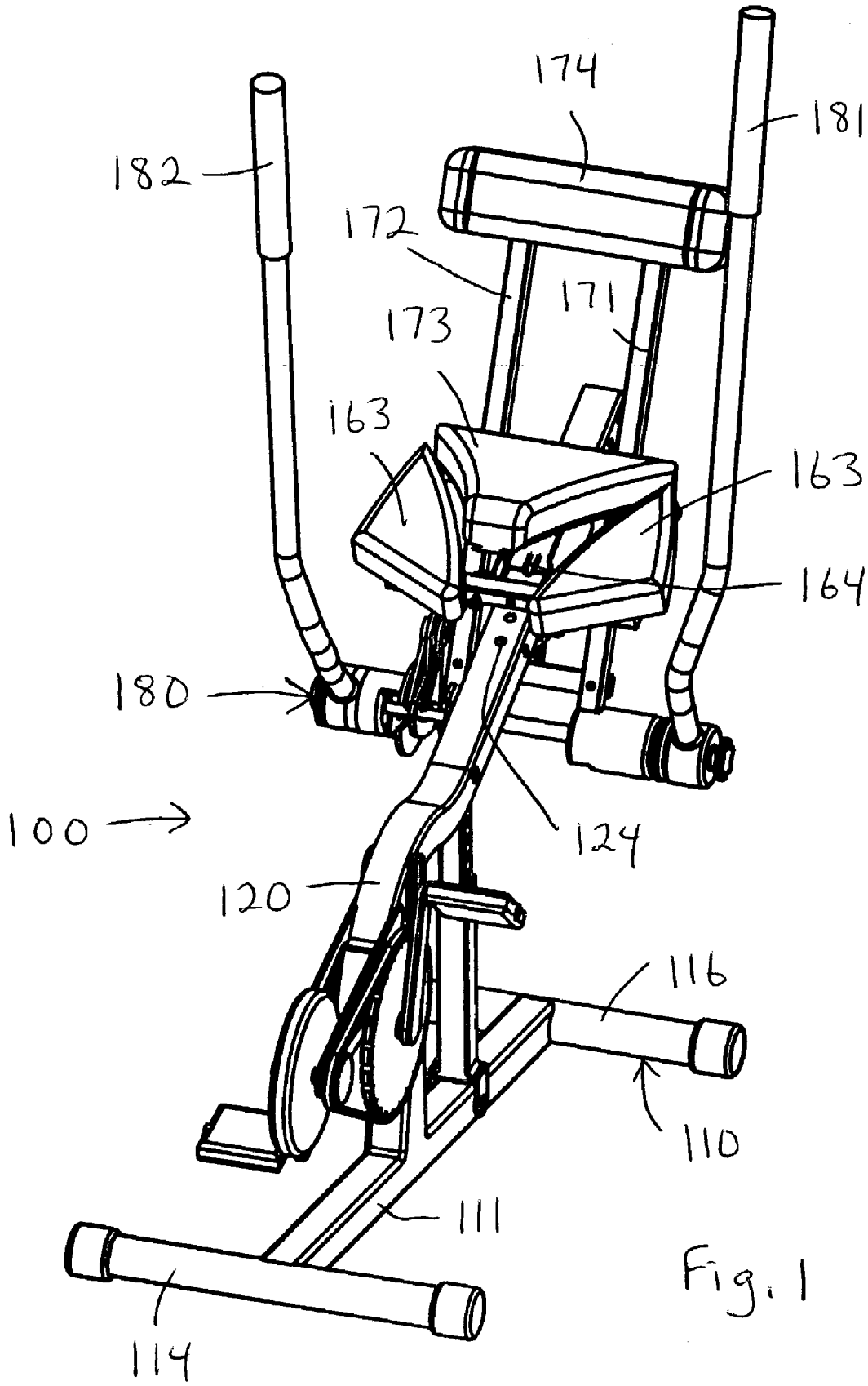
FIG. 1 is a perspective view of a preferred embodiment exercise apparatus constructed according to the principles of the present invention.
Figure 2:
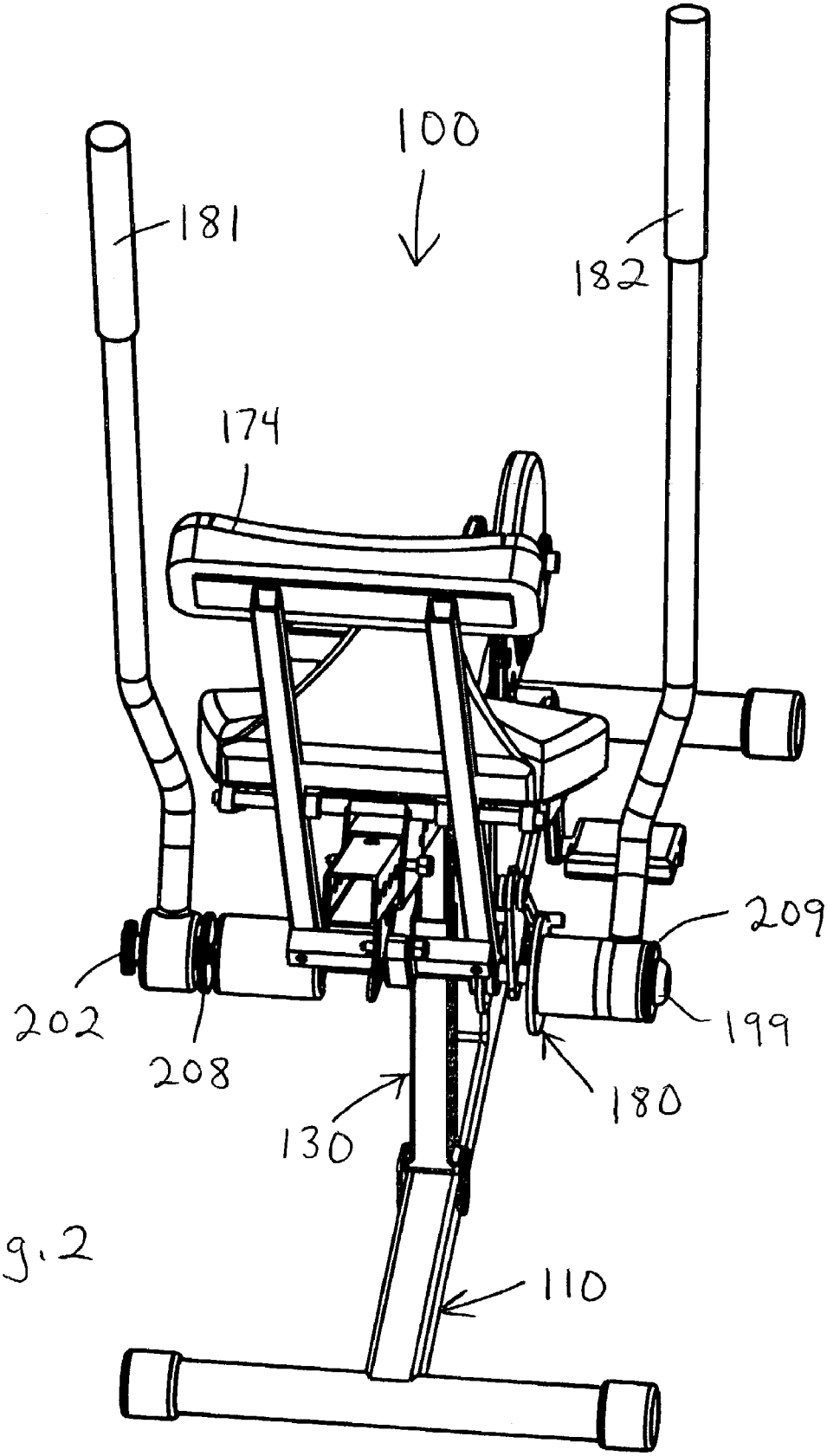
FIG. 2 is another perspective view of the exercise apparatus of FIG. 1.

A preferred embodiment exercise apparatus constructed according to the principles of the present invention is designated as 100 in FIGS. 1–5. The apparatus 100 may be described as a cycling machine or stationary bike. As suggested by FIGS. 3–5, the apparatus 100 may be configured in different ways to accommodate different postures or forms of cycling exercise. The apparatus 100 generally includes a frame 110, a beam 120 pivotally mounted on the frame 110, a means 130 for selectively pivoting the beam 120 relative to the frame 110, a pedal assembly 140 mounted on the beam 120, and a seat assembly 160 mounted on the beam 120.

The frame 110 include an I-shaped base 111 that is configured to rest on a floor surface, and that may be described in terms of a front end 114 and a rear end 116. A stanchion 112 extends upward from an intermediate portion of the base 111, and an intermediate portion of the beam 120 is pivotally mounted on top of the stanchion 112. As suggested by FIGS. 3–5, the beam 120 pivots about a pivot axis P relative to the frame 110.

The selective pivoting means 130 may also be described as an adjustable length member or telescoping member having a cylinder portion 131 pivotally connected to the base 111, and a rod portion 132 pivotally connected to the beam 120. The telescoping member 130 and its associated pivot points are disposed rearward of the stanchion 112 (and the pivot axis P). Multiple holes 134 extend through the rod portion 132 and alternately align with a hole 133 in the cylinder portion 131 to receive a detent pin or other suitable fastener 139. The selected length of the telescoping member 130 determines the orientation of the beam 120 relative to the base 111 and the underlying floor surface.

Those skilled in the art will recognize that the present invention may be implemented with other forms of pivoting means. For example, a powered actuator may be substituted for the telescoping member 130. Another possibility is to replace the telescoping member 130 with a bracket on the stanchion 112 and/or a bracket on the beam 120. At least one such bracket would define a plurality of holes that are arranged in an arc about the beam pivot axis P, and that alternately align with a hole or holes in the other member to receive a fastener. An example of this sort of bracket arrangement is used on the preferred embodiment 100 to adjust the orientation of the seat 173 (as described below).

The pedal assembly 140 is mounted on a forward end of the beam 120 (forward of the beam pivot axis P). The pedal assembly 140 includes left and right pedals 141 and 142 that rotate about a common crank axis, and a flywheel 146 that is linked in "stepped-up" fashion to the pedals 141 and 142. Various types of known resistance devices may be connected to the flywheel 146 and/or the pedals 141 and 142, as well. Alternatively, the cranks 141 and 142 could be driven by a motor to facilitate passive exercise. In any event, the pedal assembly 140 may be described as operating in a manner known in the art. In addition to enhancing inertia associated with pedaling activity, the flywheel 146 is also configured and arranged to impose a moment force on the beam 120 that tends to counteract a moment force imposed on the beam 120 by the seat assembly 160.

Figure 3:
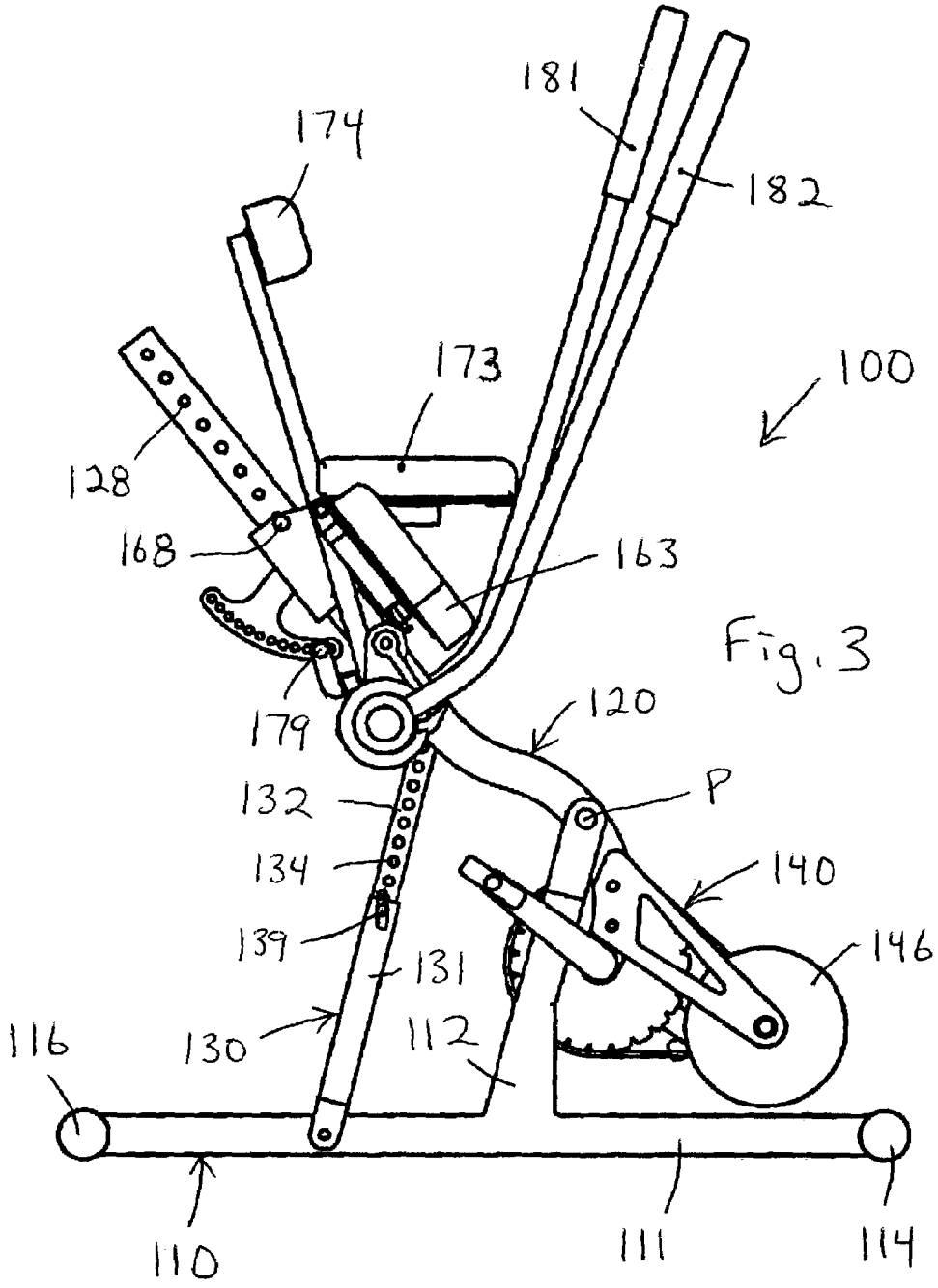
FIG. 3 is a side view of the exercise apparatus of FIG. 1 in a generally upright cycling configuration.
Figure 4:
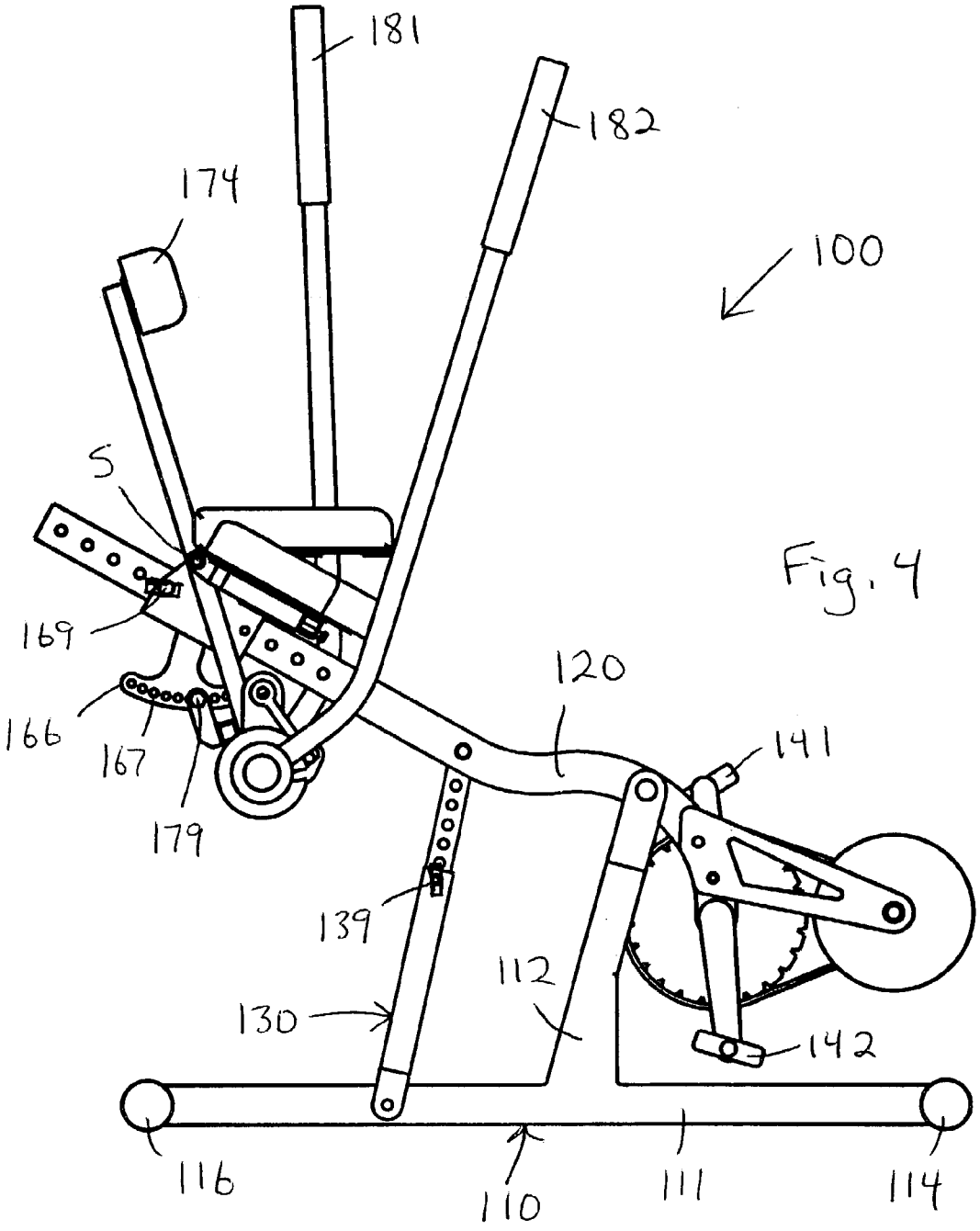
FIG. 4 is a side view of the exercise apparatus of FIG. 1 in a semi-recumbent cycling configuration.
Figure 5:
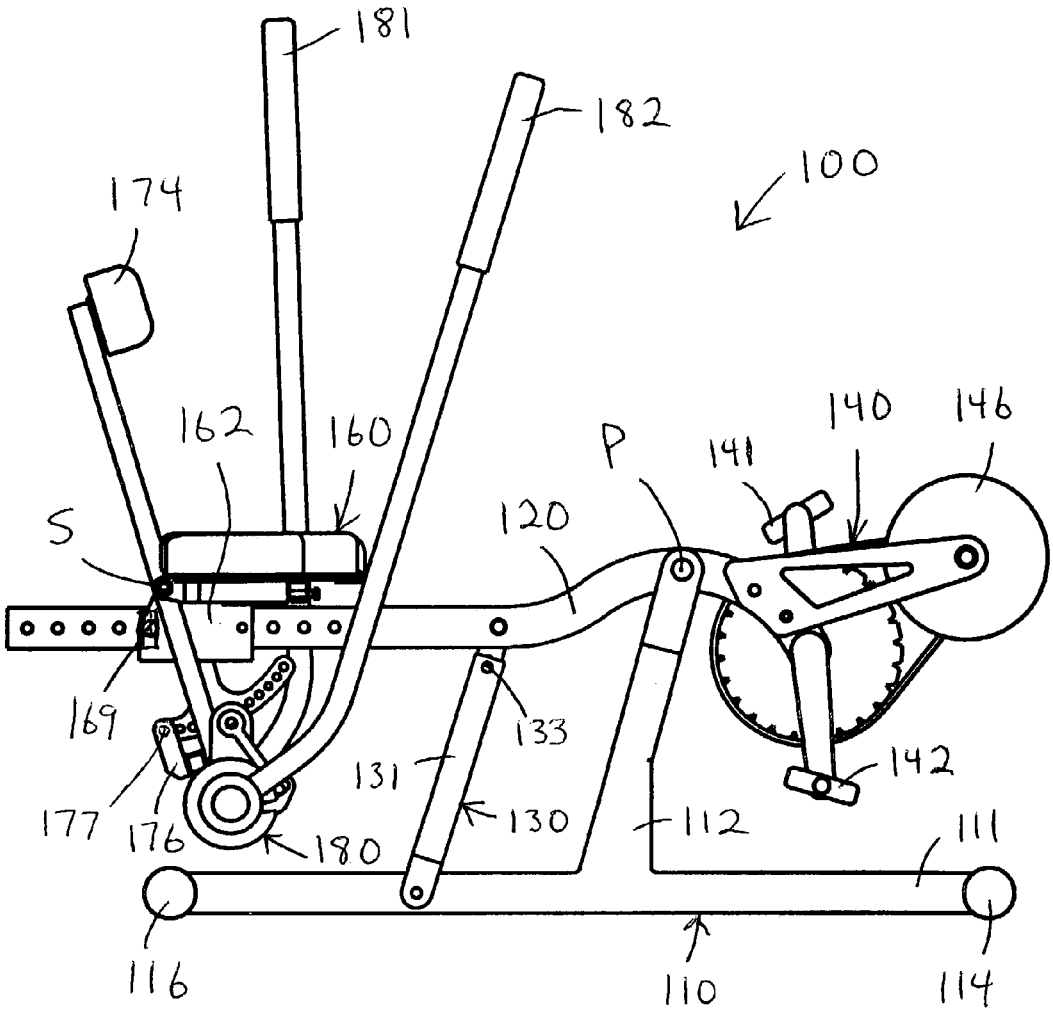
FIG. 5 is a side view of the exercise apparatus of FIG. 1 in a generally recumbent cycling configuration.

The seat assembly 160 is mounted on a rearward end of the beam 120 (rearward of the beam pivot axis P). As shown in FIG. 5, the seat assembly 160 includes a seat frame 162 that is movably mounted on the beam 120. The seat frame 162 includes a sleeve that fits about the beam 120, and low friction bearing surfaces and/or rollers to facilitate movement along the beam 120. As shown in FIG. 3, a hole 168 in the seat frame 162 aligns with any of several holes 128 in the side walls of the beam 120 to receive a fastener 169 (shown in FIGS. 4 and 5), thereby accommodating changes in distance between the seat assembly 160 and the pedal assembly 140.

As shown in FIG. 1, a flange or tongue 164 projects forward and downward from the seat frame 162, and is configured to engage any of several holes 124 in a top wall of the beam 120 as the seat frame 162 slides along the beam 120. This arrangement provides intermittent stops for the seat assembly 160 as it is adjusted along the beam 120, and requires a user to lift upward on the seat assembly 160 to free the seat assembly 160 for downward movement along the beam 120. The stop points defined by holes 124 are preferably arranged to alternately align the hole 168 with respective holes 128.

Left and right thigh supports 163 are rigidly mounted on opposite sides of the seat frame 162, and a seat 173 is disposed between the thigh supports 163 and pivotally connected to the seat frame 162. As shown in FIGS. 4–5, the seat 173 pivots about a seat pivot axis S. The seat 173 is generally similar in size and shape to a conventional bicycle seat, and in any event, is configured to support a person in a semi-recumbent or generally upright cycling position. The seat 173 is also configured to cooperate with the thigh supports 163 to support a person in a recumbent cycling position. A back support 174 is rigidly connected to the seat 173 by bars 171 and 172, and the back support 174 and the seat 172 may be described collectively as a chair.

The seat frame 162 includes a bracket 166 that is rigidly secured to the sleeve, and that defines a plurality of holes 167 (see FIG. 4) arranged in an arc about the seat pivot axis S. Another bracket 176 (see FIG. 5) is rigidly connected to the seat 173 (via bars 171 and 172) and defines a hole 177 that aligns with any of the holes 167 to receive a fastener 179 (see FIGS. 3–4). The fastener 179 is inserted through the hole 177 and a desired hole 167 to lock the seat 173 (and the back support 174) in a particular orientation relative to the seat frame 162 (and the thigh supports 163).

An arm exercise assembly 180 is mounted on the chair configuration defined by the seat 173 and the back support 174. More specifically, the left and right bars 171 and 172 have upper ends connected to the back support 174, intermediate portions connected to the seat 173, and lower ends configured to support the arm exercise assembly 180. Generally speaking, the arm assembly 180 includes left and right arms or handle members 181 and 182 that may be switched between three different modes of operation. Adjustable resistance to movement of the arms 181 and 182 may be provided, as well.

Figure 6:
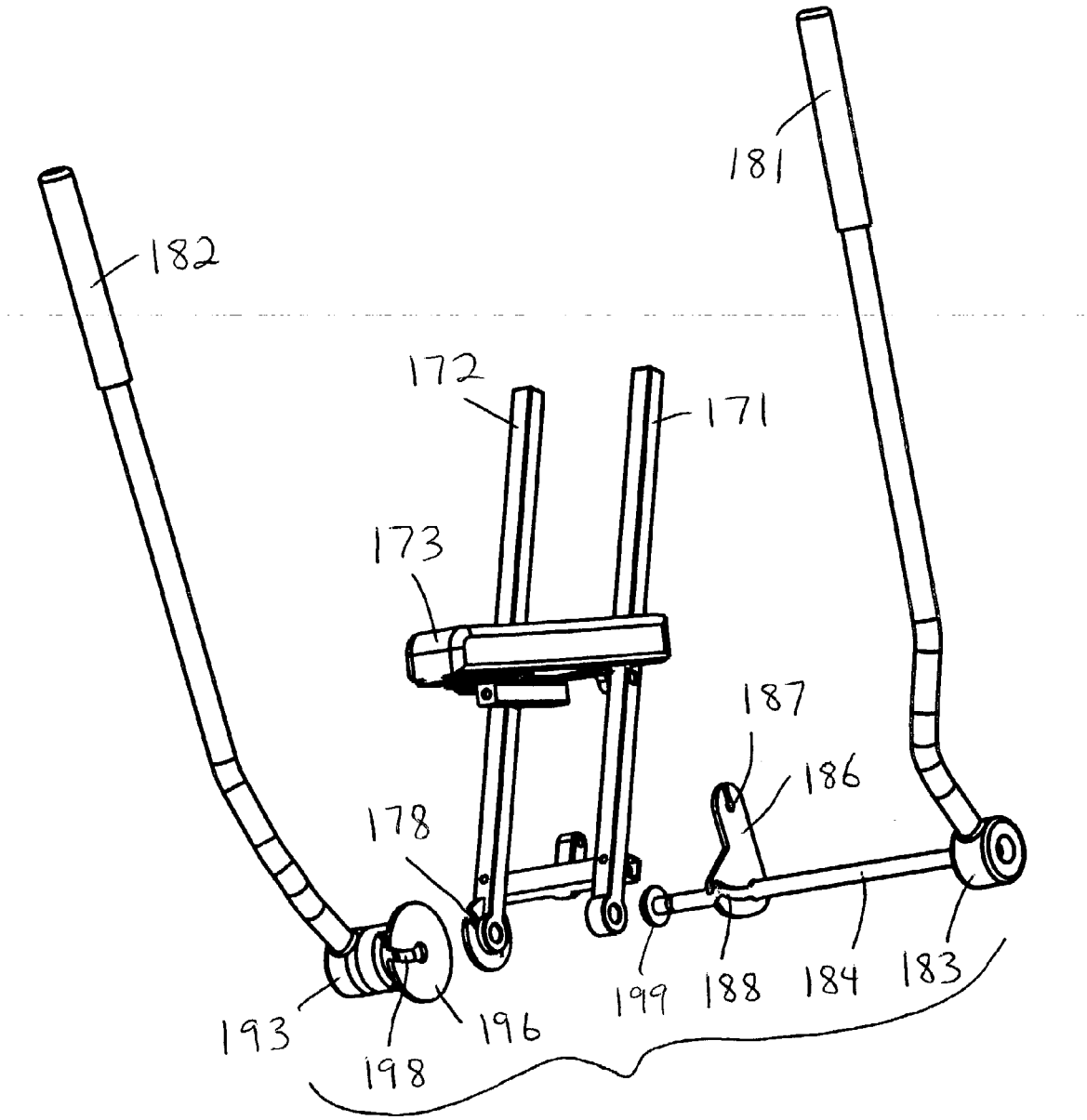
FIG. 6 is an exploded perspective view of certain parts of the exercise apparatus of FIG. 1.
Figure 7:
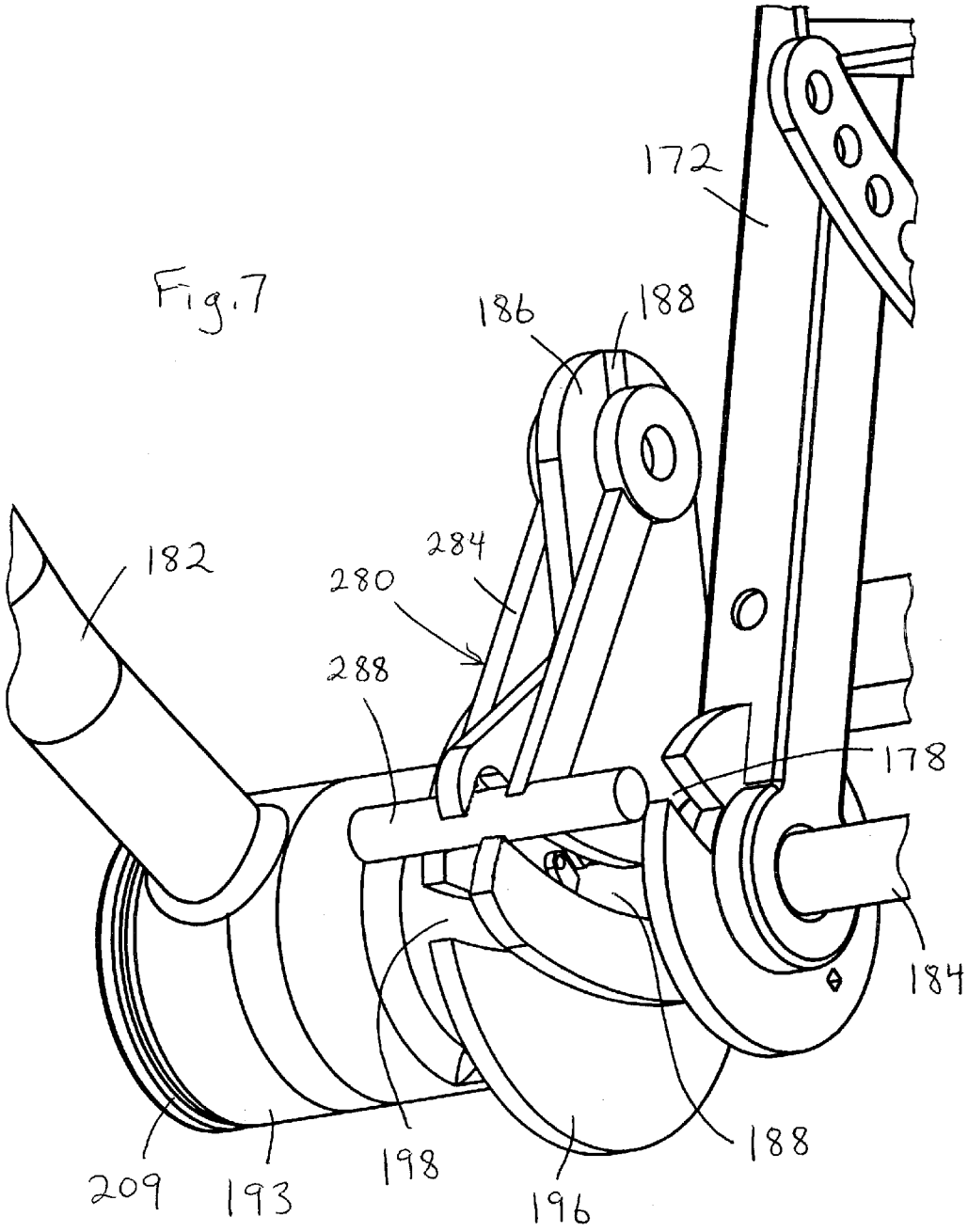
FIG. 7 is a fragmented perspective view of a handlebar linkage on the exercise apparatus of FIG. 1.
Figure 8:
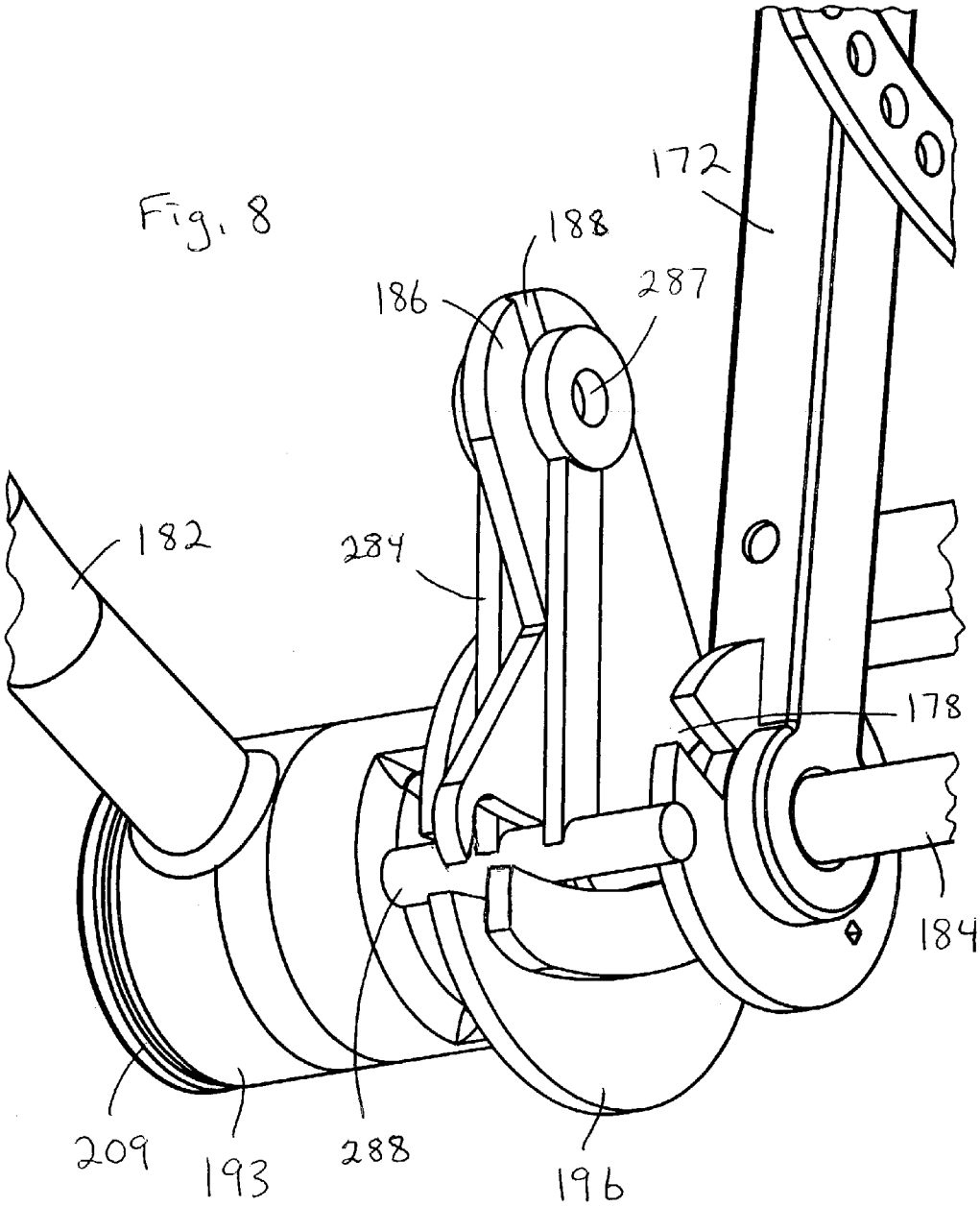
FIG. 8 is a fragmented perspective view of the handlebar linkage of FIG. 7 shifted into a different mode of operation.

Details of the arm exercise assembly 180 are shown in FIGS. 6–8. Each arm 181 and 182 has an upper end that is sized and configured for grasping, and an opposite, lower end that is secured to a respective hub 183 or 193. A shaft 184 has a first end that is keyed to the hub 183 on the left arm 181, and an opposite, second end that extends through the hub 193 on the right arm 182. A plate 186 is rigidly secured (by welding or other suitable means) to the shaft 184 relatively closer to the second end. The first end of the shaft 184 is inserted through openings provided in the lower ends of the bars 172 and 171, and then through a spacer, a friction disc arrangement 208, and a keyhole arrangement on the hub 183. A knob 202 is then threaded onto the first end of the shaft 184. A spacer is disposed on the opposite, second end of the shaft 184, followed by the hub 193, another friction disc arrangement 209, and an end fastener 199. The knob 202 cooperates with the fastener 199 to hold the intervening parts therebetween, and to impose a variable compressive force on those parts.

A hole 187 extends through an upper portion of the plate 186, and an arcuate slot 188, centered about the hole 187, is provided in an opposite, lower portion of the plate 186. As shown in FIGS. 7–8, a user operated member 280 is movably mounted on the plate 186. The member 280 includes opposing fingers 284 having lower ends that are connected to a transverse pin 288. Opposite, upper ends of the fingers 284 define holes 287 that align with the hole 187 to receive a bolt or other suitable fastener (not shown). The fingers 284 are disposed on opposite sides of the plate 186, and an intermediate portion of the pin 288 extends through the slot 188 in the plate 186. Assembly of this portion of the arm assembly 180 may be facilitated by making the slot 188 open-ended (as shown in FIGS. 7–8), and sliding the pin 288 into the slot 188 before inserting the fastener through the holes 287 and 187.

A plate 196 is rigidly secured or otherwise keyed to the right hub 193, and the plate 196 defines a notch 198 that is sized and configured to accommodate a distal end of the pin 288. On an opposite side of the plate 186, the bar 172 similarly defines a notch 178 that is sized and configured to accommodate an opposite, distal end of the pin 288. The notch 178 extends radially outward a first distance from the shaft 184, and the notch 198 extends radially outward a second, relatively greater distance from the shaft 184. The arcuate slot 188 in the plate 186 extends a third, even greater distance from the shaft 184.

The plate 186 is constrained to rotate together with the left arm 181, and in the absence of outside influence (such as a person moving the operator member 280) the pin 288 is biased to remain in place within the slot 188 in the plate 186. This biasing may be accomplished by various methods known in the art, including, for example, a detent arrangement. In this regard, a custom plastic washer may be configured to "key" onto one of the fingers 284, and to provide circumferentially spaced leaf springs or nubs that alternately engage a groove 187 in the top of the plate 186. Such a washer may be held in place by the fastener that interconnects the fingers 284 and the plate 186. The washer may also be configured for grasping between a person's thumb and forefinger, thereby providing a means for operating the operator member 280.

When the pin 288 occupies the position shown in FIG. 7, it remains free of the notches 178 and 198, thereby leaving the left arm 181 free to pivot relative to the seat bar 172, and the arms 181 and 182 free to pivot relative to one another. When the pin 288 is moved to the position shown in FIG. 8, it is captured within the notch 198 but remains free of the notch 178, thereby constraining the arms 181 and 182 to pivot together relative to the seat bar 172. The notch 198 and the slot 188 are preferably configured and arranged so that the arms 181 and 182 extend parallel to one another when locked together. When the pin 288 is moved into the notch 178 (as well as the notch 198) the arms 181 and 182 are locked in place relative to the seat bar 172. The slot 188 and notches 178 and 198 are preferably configured and arranged to lock the arms 181 and 182 in a desired position relative to the seat bar 172.

As noted above, the apparatus 100 may be adjusted to accommodate any of several cycling positions. In this regard, the fastener 139 may be removed from at least the rod portion 132 of the telescoping member 130 to accommodate pivoting of the beam 120 relative to the frame 110. Among other things, a dampener may be incorporated into the telescoping member 130 to limit the speed of pivoting for safety purposes. In any event, when the beam 120 is pivoted to a desired orientation, the fastener 139 is inserted back into the telescoping member 130 to lock the beam 120 in place.

As also noted above, the seat 173 (and the back support 174) may be adjusted to accommodate any given orientation of the beam 120. In this regard, the fastener 179 may be removed from at least the bracket 166 to accommodate pivoting of the seat 173 (and the back support 174) relative to the seat frame 162. When the seat 173 is pivoted to a desired orientation (preferably horizontal), the fastener 179 is inserted into the brackets 176 and 166 to lock the seat 173 (and the back support 174) in place.

As further noted above, the seat assembly 160 may be adjusted along the beam 120 to define a desired distance between the seat assembly 160 and the pedal assembly 140. In this regard, the fastener 169 may be removed from at least the beam 120 to accommodate movement of the seat assembly 160 along the beam 120. When the seat assembly 160 is moved to a desired location, the fastener 169 is inserted into the seat frame 162 and the beam 120 to lock the seat assembly 160 in place. When the beam 120 occupies a relatively vertical orientation (see FIG. 3), the intermittent stops provided by the holes 124 and the tab 164 are available to assume a relatively greater burden during adjustment of the seat assembly 160 along the beam 120.

The adjustability of the seat assembly 160 not only accommodates persons of different sizes, but also facilitates adjustments based upon changes between cycling configurations. For example, the same person may require different seat assembly locations depending on the orientation of the beam 120. Also, those skilled in the art will recognize that the foregoing adjustments may be performed in other ways, including ways that combine more than one adjustment into a single operation. For example, a linkage may be movably interconnected between the telescoping member 130 and the seat 173 in a manner that automatically maintains the seat 173 in a horizontal orientation as the beam 120 pivots relative to the frame 110.

FIG. 3 shows the apparatus 100 in a mostly upright or traditional configuration. FIG. 4 shows the apparatus 100 in a semi-recumbent configuration. FIG. 5 shows the apparatus 100 in a generally recumbent configuration. In any of these configurations, the arms 181 and 182 may be operated in any of the three modes of operation discussed above. Moreover, resistance to arm exercise may be adjusted by tightening or loosening the knob 202.

The foregoing description and accompanying drawings are directed toward a preferred embodiment and a specific application with the understanding that many variations and modifications may be made without departing from the scope of the present invention. Recognizing that this disclosure will enable persons skilled in the art to derive various embodiments, modifications, and/or applications, the scope of the present invention should be limited only to the extent of the claims which follow.

What is claimed is:

1. An exercise apparatus, comprising:

a frame configured to rest upon a floor surface;

a beam having a first end portion, an intermediate portion, and an opposite, second end portion, wherein the intermediate portion is pivotally connected to the frame;

a pedal assembly mounted on the first end portion;

a seat assembly mounted on the second end portion, wherein the seat assembly includes a seat frame movably mounted on the beam for selective movement along the beam, and a seat pivotally mounted on the seat frame for selective pivoting relative to the seat frame to orient the seat relative to the frame independent of beam orientation relative to the frame; and an adjustable length member interconnected between the beam and the frame, and set at a first length to maintain the beam in a first orientation, with the pedal assembly and the seat assembly positioned to define a first, relatively more recumbent cycling configuration, and alternatively set at a second length to maintain the beam in a second orientation, with the pedal assembly and the seat assembly positioned to define a second, relatively less recumbent cycling configuration.

2. The exercise apparatus of claim 1, wherein the seat is sized and configured to support a person in the second cycling configuration, and the seat assembly further includes left and right thigh supports disposed on opposite sides of the seat, and sized and configured to support a person's thighs in the recumbent first cycling configuration.

3. The exercise apparatus of claim 2, wherein the thigh supports are rigidly connected to the seat frame.

4. The exercise apparatus of claim 3, further comprising left and right handles pivotally mounted on the seat assembly.

5. The exercise apparatus of claim 3, wherein the seat assembly further includes a back support rigidly connected to the seat.

6. The exercise apparatus of claim 1, wherein a bracket is rigidly connected to the seat frame, and a fastener is inserted through a hole associated with the seat and one of several holes in the bracket to selectively secure the seat in a respective orientation relative to the seat frame.

7. The exercise apparatus of claim 1, wherein the adjustable length member is connected a portion of the beam forward of the seat and rearward of a pivot axis defined by the beam and the frame.

8. The exercise apparatus of claim 1, wherein the pedal assembly includes left and right pedals rotatably mounted on the first end portion of the beam, and a flywheel rotatably mounted on the first end portion of the beam and linked to the pedals.

9. The exercise apparatus of claim 8, wherein the flywheel is disposed forward of the pedals to counterbalance the seat relative to a pivot axis defined by pivoting of the beam relative to the frame.

10. An exercise apparatus, comprising:

a frame configured to rest upon a floor surface;

a beam having a first end portion, an intermediate portion, and an opposite, second end portion, wherein the intermediate portion is pivotally connected to the frame;

a pedal assembly mounted on the first end portion;

a seat assembly mounted on the second end portion, wherein the seat assembly includes a seat having an upwardly facing seat surface; and a means for selectively adjusting the seat and the beam relative to the frame between a first configuration, wherein the seat surface is disposed a first distance from the floor surface, and the pedal assembly cycles through a path disposed at least in part above a plane defined by the seat surface, and a second configuration, wherein the seat surface is disposed a relatively greater, second distance from the floor surface, and to the pedal assembly path is disposed entirely beneath the plane defined by the seat surface.

11. An exercise apparatus, comprising:

a frame configured to rest upon a floor surface;

a beam having a first end portion, an intermediate portion, and an opposite, second end portion, wherein the intermediate portion is pivotally connected to the frame;

a pedal assembly mounted on the first end portion;

a seat assembly mounted on the second end portion, wherein the seat assembly includes a seat frame movably mounted on the beam for selective movement along the beam, a seat pivotally connected to the seat frame, a bracket rigidly connected to the seat frame, and a fastener inserted through a hole associated with the seat and one of several holes in the bracket to selectively secure the seat in a respective orientation relative to the seat frame; and a means for selectively pivoting the beam relative to the frame between a first orientation, wherein the pedal assembly occupies a relatively more recumbent cycling position relative to the seat, and a second orientation, wherein the pedal assembly occupies a relatively less recumbent cycling position relative to the seat.

12. The exercise apparatus of claim 11, wherein the seat assembly includes left and right thigh supports disposed on opposite sides of the seat and mounted on the seat frame independent of the seat.

13. The exercise apparatus of claim 10, wherein the means includes an adjustable length member interconnected between the frame and the beam.

14. The exercise apparatus of claim 10, wherein the seat assembly is adjustably mounted on the second end portion of the beam for selective movement along the beam.

15. An exercise apparatus, comprising:

a frame configured to rest upon a floor surface;

a beam having a first end portion, an intermediate portion, and an opposite, second end portion, wherein the intermediate portion is pivotally connected to the frame;

a pedal assembly mounted on the first end portion;

a seat assembly mounted on the second end portion, wherein the seat assembly includes a seat sized and configured to support a person in a semi-recumbent cycling position, and left and right thigh supports disposed on opposite sides of the seat, and sized and configured to cooperate with the seat to support a person in a recumbent cycling position; and a means for adjusting the seat assembly upon pivoting of the beam relative to the floor surface in a manner that maintains the seat in a common orientation relative to the floor surface and the thigh supports in a common orientation relative to the beam.

16. The exercise apparatus of claim 15, wherein the seat assembly includes a seat frame, and the thigh supports are rigidly connected to the seat frame, and the seat is pivotally connected to the seat frame.

17. The exercise apparatus of claim 16, wherein the seat assembly includes a back support rigidly connected to the seat frame.

18. The exercise apparatus of claim 16, wherein the adjustment means includes a bracket rigidly connected to the seat frame, and a fastener inserted through a hole associated with the seat and one of several holes in the bracket to selectively secure the seat in a respective orientation relative to the seat frame.

19. The exercise apparatus of claim 15, wherein the seat assembly is adjustably mounted on the second end portion of the beam for selective movement along the beam.

20. An exercise apparatus, comprising:

a frame configured to rest upon a floor surface;

a beam having a forward end portion, an intermediate portion, and an opposite, rearward end portion, wherein the intermediate portion is pivotally connected to the frame, thereby defining a pivot axis;

a means for selectively pivoting the beam about the pivot axis relative to the frame;

a seat assembly mounted on the rearward end portion, wherein the seat assembly is movably mounted on the second end portion of the beam, and further comprising a stopping means for intermittently stopping movement of the seat assembly along the second end portion of the beam;

a pedal assembly mounted on the forward end portion, wherein the pedal assembly includes left and right pedals, and a flywheel linked to the pedals and disposed forward of the pedals to counterbalance the seat assembly relative to the pivot axis.

21. The exercise apparatus of claim 20, wherein the means includes an adjustable length member interconnected between the beam and the frame.

22. The exercise apparatus of claim 20, wherein the seat assembly includes a seat sized and configured to support a person in a semi-recumbent cycling position when the beam is pivoted away from a horizontal orientation, and left and right thigh supports disposed on opposite sides of the seat, and sized and configured to cooperate with the seat to support a person in a recumbent cycling position when the beam is pivoted toward a horizontal orientation.

23. An exercise apparatus, comprising:

a frame configured to rest upon a floor surface;

a beam having a first end portion, an intermediate portion, and an opposite, second end portion, wherein the intermediate portion is pivotally connected to the frame, thereby defining a pivot axis;

a pedal assembly mounted on the first end portion;

a seat assembly having a frame movably mounted on the second end portion for selective movement along the second end portion and a seat pivotally mounted on the seat frame for selective pivoting relative to the seat frame to maintain the seat in a desired orientation relative to the floor surface upon pivoting of the beam about the pivot axis.

24. The exercise apparatus of claim 23, wherein the seat is sized and configured to support a person in a semi-recumbent cycling position, and further comprising left and right thigh supports disposed on opposite sides of the seat and sized and configured to cooperate with the seat to support a person in a recumbent cycling position.

25. The exercise apparatus of claim 23, further comprising left and right handles pivotally mounted on the seat assembly.

* * * * *